US006841692B2

(12) United States Patent
Kase et al.

(10) Patent No.: US 6,841,692 B2
(45) Date of Patent: Jan. 11, 2005

(54) METHOD FOR PRODUCING A FATTY ACID

(75) Inventors: Minoru Kase, Kashima-gun (JP); Eizo Maruyama, Kashima-gun (JP); Hiroaki Yamaguchi, Kashima-gun (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/454,493

(22) Filed: Jun. 5, 2003

(65) Prior Publication Data

US 2004/0030169 A1 Feb. 12, 2004

(30) Foreign Application Priority Data

Jun. 14, 2002 (JP) ..... 2002-174405

(51) Int. Cl.[7] ..... C11B 3/00
(52) U.S. Cl. ..... 554/208; 554/211
(58) Field of Search ..... 554/208, 211

(56) References Cited

U.S. PATENT DOCUMENTS 5,952,518 A * 9/1999 Sugiura et al. ..... 554/208

* cited by examiner

*Primary Examiner*—Deborah D. Carr
(74) *Attorney, Agent, or Firm*—Oblon, Spivak, McClelland, Maier & Neustadt, P.C.

(57) ABSTRACT

The present invention provides a method for separating a saturated fatty acid and an unsaturated fatty acid from a mixture of fatty acids by a dry fractionation process with a superior efficiency. Namely, the present invention provides a method for producing a saturated fatty acid or an unsaturated fatty acid comprising a dry fractionation process to fractionate a saturated fatty acid and an unsaturated fatty acid in a raw fatty acids mixture by adding a polyglycerol ester of fatty acid to the raw fatty acids mixture, wherein the polyglycerol ester of fatty acid has a clear melting point (y) satisfying the following formula (1):

$$0.38x+13 \leqq y \leqq 0.54x+44 \quad (1)$$

wherein x is a ratio (% by mass) of saturated fatty acids ($C_{12}$ to $C_{22}$) in raw fatty acids, and y is a clear melting point (° C.) of a polyglycerol ester of fatty acid.

17 Claims, No Drawings

METHOD FOR PRODUCING A FATTY ACID

FIELD OF THE INVENTION

The present invention relates to a method for separating a saturated fatty acid and an unsaturated fatty acid from a mixture of fatty acids by a dry fractionation process with a superior efficiency.

BACKGROUND OF THE INVENTION

Fatty acids are widely utilized as an intermediate raw material of foods, such as a monoglyceride and a diglyceride, as well as an additive, and an intermediate raw material for other sorts of industrial products. These fatty acids are generally produced by hydrolyzing a vegetable oil such as a rapeseed oil, a soybean oil, a sunflower oil, a palm oil, or an animal oil such as beef tallow, using a high pressure method, or a decomposition method with an enzyme.

However, fatty acids produced simply by hydrolyzing an animal oil or a vegetable oil as described above, which have natural fatty acid compositions, are not necessarily suitable as a basic raw material for industrial use. In other words, it is necessary to fractionate unsaturated fatty acids and saturated fatty acids depending on the utilization purpose.

Therefore, it becomes necessary to modify a fatty acid composition to obtain a desired mixture of fatty acids. Generally in the fractionation process of fatty acids, a fractionation process using a solvent and a fractionation process using a wetting agent are employed. Although these processes show high efficiencies (e.g. yields) of separation, they pose problems such as an initial cost for facility investment as well as a high running cost for recovery of the solvent or the aqueous solution of the wetting agent and the like. In contrast, a dry fractionation process without using any solvent (e.g. a no solvent process) is an inexpensive fractionation process, and an attempt to solve such problem, by lowering the filtration rate, has been made by employing an emulsifier such as a polyglycerol ester of a fatty acid (JP-A-11-106782).

SUMMARY OF THE INVENTION

The present invention provides a method for producing a saturated fatty acid or an unsaturated fatty acid, comprising a dry fractionation process to fractionate a saturated fatty acid and an unsaturated fatty acid in a raw fatty acids mixture by adding a polyglycerol ester of a fatty acid to the raw fatty acids mixture, wherein the polyglycerol ester of a fatty acid has a clear melting point (y) satisfying the following formula (1):

$$0.38x+13 \leqq y \leqq 0.54x+44 \quad (1)$$

wherein x is a ratio (% by mass) of saturated fatty acids ($C_{12}$ to $C_{22}$) in a raw fatty acids mixture, and y is a clear melting point (° C.) of a polyglycerol ester of a fatty acid.

DETAILED DESCRIPTION OF THE INVENTION

However, even with the dry fractionation process using a polyglycerol ester of a fatty acid, it has become apparent that there are still cases wherein sufficiently large crystals cannot necessarily be deposited and the efficiency of filtration is low; the quality is poor; the yield is low; and the like.

Therefore, the present invention provides a dry fractionation process of fatty acids using a polyglycerol ester of a fatty acid, which is further improved in efficiency of filtration, and in the quality and yield of products.

Thus, the present inventors extensively studied the relationship between a composition of fatty acids to be fractionated and a polyglycerol ester of a fatty acid as an additive, and found that when a specified relationship was satisfied between a clear melting point of a polyglycerol ester of a fatty acid employed and a ratio of saturated fatty acids in a raw fatty acids mixture, a saturated fatty acid and an unsaturated fatty acid could be fractionated with superior efficiency, since the size of crystals of a saturated fatty acid deposited in a raw fatty acids mixture became large and the efficiency of filtration could be remarkably improved.

In the present invention, "a dry fractionation process" means a process to perform solid-liquid separation by cooling a raw fatty acids mixture while stirring, without using water in an amount such as to allow a phase separation and without using any solvent. If necessary, a further step of separating a solid component deposited thereby using a separation system such as filtration, centrifugation and sedimentation is preferred. "A ratio of saturated fatty acids" means a value as measured by gas chromatography, and "a clear melting point" means a value as measured according to The Standard Fat and Oil Analyzing Method (2.2.4.1-1996) (Nihonyukagakukai).

In a preferred embodiment of the present invention, a raw fatty acids mixture to be fractionated to saturated fatty acids and unsaturated fatty acids is produced by hydrolyzing a vegetable oil such as a rapeseed oil, a soybean oil, a sunflower oil, a palm oil, or an animal oil, such as beef tallow, by a steam decomposition method, by utilizing lipase enzyme or the like. The method according to the present invention is effective when an amount of fatty acids in a raw fatty acids mixture is preferably not lower than 50% by weight, particularly not lower than 85% by weight, and furthermore, a partial glyceride may be contained therein. Furthermore, a raw fatty acids mixture, those having a ratio of saturated fatty acids ($C_{12}$ to $C_{22}$) such as palmitic acid and stearic acid in the fatty acid composition in an amount of 8 to 70% by weight, particularly 10 to 55% by weight, are preferred.

The polyglycerol ester of a fatty acid used in the present invention preferably has a clear melting point (y) in the range as represented by the above-described formula (1), even more preferably a clear melting point higher than the clear melting point of the raw fatty acids mixture. When a clear melting point of the polyglycerol ester of a fatty acid is out of the range as represented by the formula (1), the size of crystals deposited becomes fine, and as a result, filtration becomes almost impossible because of clogging and the efficiency of filtration is lowered. The preferred range of a clear melting point (y) is preferably $0.38\ x+19 \leqq y \leqq 0.54\ x+40$, and more preferably $0.38\ x+28 \leqq y \leqq 0.54\ x+36$. Also in this case, the clear melting point of the polyglycerol ester of fatty acid is preferably in a range from the clear melting point of the raw fatty acids mixture minus 5° C. to that of the mixture plus 40° C., more preferably in a range from that of the mixture minus 0° C. to that of the mixture plus 30° C.

The raw fatty acids start to crystallize when they are cooled. If no additive is used, they form very fine crystals and become a slurry with less fluidity, which is very difficult for solid-liquid separation. On the other hand, if they are cooled with an additive such as a polyglycerol ester of fatty acid being added, they form granular crystals and become a solid-liquid mixture which is easy in the solid-liquid separation. This behavior is already disclosed in JP-A-11-106782.

In the present invention, it has been found that use of a polyglycerol ester of fatty acid with a specific melting point as an additive in such a case results in forming a solid-liquid mixture containing crystals with a large size, and thereby improvements in filtration efficiency, quality and yield are enabled.

Although a certain amount of unsaturated fatty acids and the like are present together in the crystals, the main component to crystallize is the saturated fatty acid, and the starting (generation of nuclei) and developing of crystallization is determined by a ratio of the saturated fatty acids in the raw fatty acids mixture. As such ratio of the saturated fatty acid is increased, the clear melting point of the raw fatty acid mixture is also increased, but the correlation is not complete. In the present invention, with regard to starting and developing of the crystallization, it has been found that the effect of such ratio on the starting and developing of crystallization is stronger than the effect of the clear melting point.

Although not wanting to be limited by theory, with regards to the reason why the size of the saturated fatty acid crystals deposited enlarges when a polyglycerol ester of a fatty acid having a clear melting point as described above is used, it is believed that the generation of nuclei is restrained in the crystallization process of the fatty acid, and the restraining effect influences the size of crystals. If the generation of new nuclei is restrained at a stage in which crystallization has proceeded to some extent and crystals have been deposited to some degree, the formation of fine crystals becomes less and hence the size of crystals becomes larger. The restraining action on the generation of nuclei is believed to be connected to the amount of saturated fatty acid and the clear melting point of a polyglycerol ester of a fatty acid.

When a melted raw fatty acids mixture is cooled, the fatty acid starts to crystallize at a certain temperature. In such a state, if a polyglycerol ester of a fatty acid, which has a melting point higher than the temperature at which the fatty acid starts to crystallize (the temperature correlating to the amount of the saturated fatty acid and different from the clear melting point of the raw fatty acids mixture itself), is added, the polyglycerol ester of the fatty acid starts to crystallize before the fatty acid crystallizes, which promotes the generation of nuclei for crystallization of the fatty acid. Then, in a state where crystallization has proceeded to some extent and crystals have deposited to some degree, the generation of new nuclei is not restrained, and thus many fine crystals deposit, which is not preferable.

On the other hand, in the crystallization of a raw fatty acids mixture, if a polyglycerol ester of a fatty acid which has a melting point much lower than the temperature at which the fatty acid starts to crystallize is added, the polyglycerol ester of a fatty acid does not influence generation of nuclei in the crystallization of the fatty acid. Namely, the generation of nuclei is neither promoted nor restrained, which is also not preferable.

The origin of the polyglycerol ester of a fatty acid is not limited so long as the ester has the above-described clear melting point. The ester may be any of those obtained by esterification of a polyglycerol and a fatty acid which is a natural product derived from an animal oil, a vegetable oil or the like as a raw material, and those obtained by esterification of a fatty acid and a synthetic polyglycerol which is obtained by polymerization of glycidol, epichlorohydrine or the like. An average degree of polymerization of the polyglycerol in the polyglycerol ester of the fatty acid is preferably not lower than 3, more preferably not lower than 5, and most preferably from 8 to 30, from the viewpoint of obtaining a crystal state easy for filtration. Furthermore, the fatty acids to be reacted with a polyglycerol are preferably composed of a saturated or unsaturated fatty acid having carbon atoms of from 10 to 22, more preferably from 12 to 18, from the viewpoint of controling the clear melting point of the polyglycerol ester of a fatty acid. Said fatty acids may be composed of a single fatty acid, but are preferably composed of a mixture of fatty acids from the viewpoint of obtaining a crystal state easy for filtration. An esterification reaction between a polyglycerol and fatty acids may be by any of the following methods, for example, a method wherein a mixture of these substances is added with an alkaline catalyst such as sodium hydroxide, then directly esterified in an inert gas stream such as nitrogen at a temperature of 200 to 260° C., and a method wherein an enzyme is used.

The above-described polyglycerol ester of a fatty acid may be used in combination of at least two kinds of esters thereof, and the amount to be added is preferably around 0.001 to 5% by weight, more preferably around 0.05 to 1% by weight, based on the raw fatty acids mixture.

According to the present invention, as described above, it is possible to produce a saturated fatty acid and an unsaturated fatty acid with superior efficiency, by adding and mixing to a raw fatty acids mixture a polyglycerol ester of a fatty acid having the above-described specified clear melting point as an additive, cooling them to deposit crystals, and fractionating the liquid portion and the crystal portion. The liquid portion is unsaturated fatty acids and the crystal portion is saturated fatty acids. Said polyglycerol ester of a fatty acid is preferably mixed with the raw fatty acids mixture and dissolved therein at a temperature higher than the clear melting point thereof so as to be completely dissolved in the raw fatty acids mixture. A cooling time and a cooling temperature after the mixing and dissolving step may appropriately be selected depending upon the composition of the raw fatty acids mixture. The cooling temperature is preferably −20 to 50° C., more preferably −10 to 40° C. The cooling time is preferably 0.5 to 30 hours, more preferably 1 to 30 hours. For instance, in the case of fatty acids derived from soybean, it is necessary to cool to −3° C. for about 1 to 30 hours, preferably for about 3 to 20 hours. Cooling may be conducted in a batch process or a continuous process. The average particle diameter of resultant crystals is preferably not smaller than 100 μm, more preferably not smaller than 200 μm, from the viewpoint of obtaining a crystal state easy for filtration. Furthermore, as a crystal-separation method, any separation systems such as filtration, centrifugation and sedimentation can be applied, and they may also be conducted in a batch process or in a continuous process.

EXAMPLES

In the preferred examples hereinbelow, a composition of fatty acids, a ratio of saturated fatty acids, and a concentration of fatty acids were measured by gas chromatography. A clear melting point of a polyglycerol ester of a fatty acid was measured according to The Standard Fat and Oil Analyzing Method (2.2.4.1-1996).

[Preparation of Raw Fatty Acids Mixtures]

Fats and oils as shown in Table 1 were hydrolyzed by a conventional method to prepare raw fatty acids mixtures. The composition of fatty acids, the ratio of saturated fatty acids and the concentration of fatty acids of each fat and oil which are used are shown in Table 1.

TABLE 1

| Raw Fatty Acids Mixture No. | Origin of Fatty Acid | Ratio of Saturated Acids in Raw Fatty Acid Mixture ($C_{12}$–$C_{22}$) [% by Mass] | 12 | 14 | 16 | 18 | 18:1 | 18:2 | 18:3 | 20 | 20:1 | 22 | 22:1 | Concentration of Fatty Acid [% by Mass] |
|---|---|---|---|---|---|---|---|---|---|---|---|---|---|---|
| 1 | Rice | 4 | 0 | 0 | 1 | 3 | 52 | 42 | 2 | 0 | 0 | 0 | 0 | 92 |
| 2 | Rapeseed | 7 | 0 | 0 | 4 | 2 | 61 | 20 | 11 | 1 | 0 | 0 | 0 | 88 |
| 3 | Perilla | 8 | 0 | 0 | 6 | 2 | 15 | 16 | 60 | 0 | 0 | 0 | 0 | 90 |
| 4 | Linseed | 11 | 0 | 0 | 7 | 4 | 20 | 15 | 54 | 0 | 0 | 0 | 0 | 91 |
| 5 | Sunflower | 11 | 0 | 0 | 6 | 4 | 21 | 66 | 1 | 0 | 0 | 1 | 0 | 90 |
| 6 | Soybean | 15 | 0 | 0 | 10 | 4 | 23 | 53 | 8 | 1 | 0 | 0 | 0 | 92 |
| 7 | Soybean 50% + Palmolein 50% | 28 | 0 | 1 | 23 | 4 | 34 | 32 | 4 | 0 | 0 | 0 | 0 | 90 |
| 8 | Palm | 43 | 0 | 4 | 32 | 7 | 49 | 7 | 0 | 0 | 0 | 0 | 0 | 93 |
| 9 | Palm | 49 | 0 | 1 | 43 | 5 | 41 | 10 | 0 | 0 | 0 | 0 | 0 | 95 |

[Fractionation of Fatty Acids]

1 to 8 g of polyglycerol esters of fatty acids as shown in Table 2 (in Table 2, PGE 31, PGE 32 and PGE 33 have an average degree of polymerization of polyglycerol of 4, and the others have that of 10) was added to 1 kg of each raw fatty acids mixture as prepared above, and is then thoroughly dissolved therein at 80° C. Then, the solution was cooled at a rate of 3° C./hr to the fractionating temperature as shown in Table 3 while stirring at 50 rpm, and maintained for one hour while stirring. Subsequently, using a filter cloth made of nylon, such as NY1260NLK (trade name, manufactured by Mitsubishi Kakoki Kaisha, Ltd.) (filtration area: 39 $cm^2$), the solution was filtrated under pressure of 0.03 MPa, and fractionated to a liquid portion (rich in unsaturated fatty acids) and a solid portion (rich in saturated fatty acids). A yield of filtrate, a filtration time required to obtain 500 ml of filtrate, a melting point of the liquid portion, and a composition of fatty acids (a ratio of saturated fatty acids having $C_{12}$ to $C_{22}$) in each of the liquid portion and the solid portion were measured (See Table 3).

As apparent from Table 3, it can be understood that when a clear melting point of the polyglycerol ester of a fatty acid used as an additive falls within the range of formula (1), the size of crystals of the saturated fatty acids deposited becomes large regardless of the type of raw fatty acids mixture, and therefore a dry fractionation of saturated fatty acids and unsaturated fatty acids can be performed within a shorter time with a higher yield. On the contrary, when a clear melting point of the polyglycerol ester of fatty acid falls out of the range of formula (1), the efficiency of filtration is lowered.

According to the present invention, regardless of the type of raw fatty acids mixture, saturated fatty acids and unsaturated fatty acids in said fatty acids mixture can be naturally fractionated readily with superior efficiency.

TABLE 2

| Polyglycerol Esters of Fatty Acids (Additives) | | | | | | | | | | | |
|---|---|---|---|---|---|---|---|---|---|---|---|
| | Fatty Acid Composition [%] | | | | | | | | | | Clear Melting |
| | 12 | 14 | 16 | 18 | 18:1 | 18:2 | 20 | 22 | AV [mg-KOH/g] | OHV | Point [° C.] |
| PGE5 | 16 | 10 | 23 | 23 | 28 | | | | 6 | 24 | 31 |
| PGE15 | | | 20 | 59 | 6 | 11 | | | 10 | 5 | 48 |
| PGE6 | 99 | 1 | | | | | | | 4 | 44 | 12 |
| PGE4 | 18 | 57 | 0 | 25 | | | | | 11 | 11 | 34 |
| PGE16 | 15 | 59 | 3 | 1 | 20 | 2 | | | 8 | 2 | 22 |
| PGE7 | | | 6 | 93 | 1 | | | | 2 | 47 | 56 |
| PGE1 | 20 | 5 | 25 | 30 | 20 | | | | 6 | 48 | 37 |
| PGE0 | 0 | 0 | 25 | 50 | 10 | 15 | | | 8 | 5 | 45 |
| PGE11 | 51 | 48 | 1 | | | | | | 3 | 47 | 24 |
| PGE12 | 20 | 20 | 19 | 20 | 20 | 1 | | | 5 | 45 | 29 |
| PGE13 | 27 | 29 | 21 | 22 | | | | | 2 | 43 | 33 |
| PGE14 | | | 1 | 8 | | | 4 | 87 | 2 | 49 | 70 |
| PGE31 | | | 25 | 53 | 7 | 14 | 1 | | 5 | 5 | 45 |
| PGE32 | | | 20 | 62 | 6 | 11 | 1 | | 4 | 6 | 47 |
| PGE33 | 99 | 1 | | | | | | | 4 | 7 | 10 |

TABLE 3

| Raw Fatty Acids Mixture No. | Additive | Component*1 of Formula (1) | Filtration Time (min.) | Amount of Additive [g] | Fractionation Temp. [° C.] | Liquid Portion: Saturated Acids ($C_{12}$–$C_{22}$) [% by mass] | Liquid Portion: Melting Point [° C.] | Liquid Portion: Yield of Liquid Portion [% by Mass] | Solid Portion Saturated Acids ($C_{12}$–$C_{22}$) [% by Mass] |
|---|---|---|---|---|---|---|---|---|---|
| 1 | PGE5 | ○ | 2 | 1 | 4 | 2 | −1 | 92 | 31 |
| 1 | PGE15 | × | <60 | 1 | 4 | — | — | 3 | — |
| 1 | PGE6 | × | <60 | 1 | 4 | — | — | 3 | — |
| 2 | PGE4 | ○ | 2 | 1 | 2 | 4 | 3 | 90 | 45 |
| 2 | PGE15 | ○ | 15 | 1 | 2 | 5 | 5 | 88 | 35 |
| 2 | PGE16 | ○ | 32 | 1 | 2 | 5 | 7 | 89 | 33 |
| 2 | PGE6 | × | <60 | 1 | 2 | — | — | 2 | — |
| 2 | PGE7 | × | <60 | 1 | 2 | — | — | 1 | — |
| 3 | PGE1 | ○ | 1 | 1 | −3 | 4 | −2 | 90 | 49 |
| 4 | PGE1 | ○ | 1 | 1 | −3 | 4 | −1 | 85 | 48 |
| 5 | PGE1 | ○ | 1 | 1 | −4 | 4 | −1 | 84 | 52 |
| 6 | PGE1 | ○ | 1 | 1 | −3 | 4 | −1 | 74 | 52 |
| 6 | PGE0 | ○ | 1 | 3 | −3 | 3 | 0 | 75 | 51 |
| 6 | PGE6 | × | <60 | 3 | −3 | — | — | 1 | — |
| 6 | PGE7 | × | <60 | 3 | −3 | — | — | 2 | — |
| 6 | PGE11 | ○ | 13 | 3 | −3 | 6 | 6 | 71 | 36 |
| 6 | PGE15 | ○ | 11 | 3 | −3 | 5 | 5 | 68 | 35 |
| 6 | PGE12 | ○ | 5 | 3 | −3 | 4 | 3 | 75 | 49 |
| 6 | PGE13 | ○ | 2 | 3 | −3 | 4 | 0 | 73 | 47 |
| 7 | PGE15 | ○ | 8 | 3 | 10 | 7 | 12 | 35 | 41 |
| 8 | PGE7 | ○ | 1 | 2 | 35 | 32 | 35 | 65 | 71 |
| 8 | PGE14 | × | <60 | 2 | 35 | — | — | 0 | — |
| 9 | PGE7 | ○ | 6 | 8 | 35 | 33 | 36 | 41 | 60 |
| 9 | PGE11 | × | <60 | 8 | 35 | — | — | 1 | — |
| 9 | PGE12 | × | <60 | 8 | 35 | — | — | 0 | — |
| 9 | PGE14 | × | <60 | 8 | 35 | — | — | 2 | — |
| 4 | PGE31 | ○ | 2 | 2 | 5 | 5 | 4 | 92 | 48 |
| 4 | PGE32 | ○ | 5 | 2 | 5 | 5 | 4 | 90 | 45 |
| 4 | PGE33 | × | <60 | 2 | 5 | — | — | 2 | — |
| 5 | PGE31 | ○ | 4 | 2 | 0 | 4 | 1 | 85 | 51 |
| 5 | PGE32 | ○ | 7 | 2 | 0 | 4 | 1 | 85 | 53 |
| 5 | PGE33 | × | <60 | 2 | 0 | — | — | 3 | — |

*1The case when a clear melting point of the polygricerol ester of fatty acid is within and out of the range defined by the formula (1) is represented by ○ and X, respectively.

What is claimed is:

1. A method for producing a saturated fatty acid or an unsaturated fatty acid, comprising:

i) determining a ratio of saturated fatty acids in a raw fatty acids mixture;

ii) selecting a polyglycerol ester of a fatty acid based on said ratio of saturated fatty acids in said raw fatty acids mixture; and iii) dry fractionating a saturated fatty acid and an unsaturated fatty acid in said raw fatty acids mixture by adding said polyglycerol ester of a fatty acid to said raw fatty acids mixture, wherein polyglycerol ester of a fatty acid has a clear melting point (y) satisfying the following formula (1):

$$0.38x+13 \leqq y \leqq 0.54x+44 \quad (1)$$

wherein x is a ratio (% by weight) of saturated fatty acids ($C_{12}$ to $C_{22}$) in said raw fatty acids mixture, and y is a clear melting point (° C.) of polyglycerol ester of a fatty acid.

2. The method according to claim 1, wherein dry fractionating is a process comprising adding and mixing a polyglycerol ester of a fatty acid to a raw fatty acids mixture; depositing crystals by cooling; and fracationating a liquid portion and a crystal portion.

3. The method of claim 1, wherein said raw fatty acids mix is produced by hydrolysis of at least one oil selected from the group consisting of vegetable oil, and animal oil.

4. The method of claim 1, wherein said raw fatty acids mixture is produced by hydrolysis of at least one oil selected from the group consisting of rapeseed oil, soybean oil, sunflower oil, palm oil, and beef tallow.

5. The method of claim 1, wherein an amount of fatty acids in said raw fatty acids mixture is not lower than 50% by weight.

6. The method of claim 1, wherein an amount of fatty acids in said raw fatty acids mixture is not lower than 85% by weight.

7. The method of claim 1, wherein said raw fatty acids mix has a ratio of saturated fatty acids in an amount of 8 to 70% by weight.

8. The method of claim 1, wherein said raw fatty acids mix has a ratio of saturated fatty acids in an amount of 10 to 55% by weight.

9. The method of claim 1, wherein said polyglycerol ester of fatty acid has a clear melting point (y) satisfying the following formula $$0.38x+19 \leqq y \leqq 0.54x+40.$$

10. The method of claim 1, wherein said polyglycerol ester of a fatty acid has a clear melting point (y) satisfying the following formula $$0.38x+28 \leqq y \leqq 0.54x+36.$$

11. The method of claim 1, wherein said polyglycerol ester of a fatty acid has a clear melting point (y) minus 5° C. to that of said mixture plus 40° C.

12. The method of claim 1, wherein said polyglycerol ester of a fatty acid has a clear melting point (y) minus 0° C. to that of said mixture plus 30° C.

13. The method of claim 1, wherein said polyglycerol ester of a fatty acid is added in an amount of 0.00 1 to 5% by weight based on said raw fatty acids mixture.

14. The method of claim 1, wherein said polyglycerol ester of a fatty acid is added in an amount of 0.05 to 1% by weight based on said raw fatty acids mixture.

15. The method of claim 2, wherein said crystals have an average particle diameter of not smaller than 100 $\mu$m.

16. The method of claim 2, wherein said crystals have an average particle diameter of not smaller than 200 $\mu$m.

17. A method for producing a saturated fatty acid or an unsaturated fatty acid, comprising:

dry fractionating a saturated fatty acid and an unsaturated fatty acid in a raw fatty acids mixture by adding a polyglycerol ester of a fatty acid to said raw fatty acids mixture, wherein said polyglycerol ester of a fatty acid has a clear melting point (y) satisfying the following formula (1):

$$0.38x+28 \leqq y \leqq 0.54x44 \quad (1)$$

wherein x is a ratio (% by weight) of saturated fatty acids (C12 to C22) in said raw fatty acids mixture, and y is a clear melting point (° C.) of said polyglycerol ester of a fatty acid.

* * * * *

UNITED STATES PATENT AND TRADEMARK OFFICE

CERTIFICATE OF CORRECTION

PATENT NO. : 6,841,692 B2
DATED : January 11, 2005
INVENTOR(S) : Minoru Kase et al.

It is certified that error appears in the above-identified patent and that said Letters Patent is hereby corrected as shown below:

Column 7,
Lines 50 and 57, replace each occurrence of "polyglycerol" with -- said polyglycerol --.
Line 61, replace "fracationating" with -- fractionating --.
Line 64, replace "mix" with -- mixture --.

Column 8,
Lines 48 and 57, replace "mix" with -- mixture --.

Column 10,
Line 6, replace "0.54x44" with -- 0.54 x+ 44 --.
Line 10, replace "(C12 to C22)" with -- ($C_{12}$ to $C_{22}$) --.

Signed and Sealed this

Seventeenth Day of May, 2005

JON W. DUDAS
*Director of the United States Patent and Trademark Office*